US009472128B2

(12) United States Patent
Rosenthal

(10) Patent No.: US 9,472,128 B2
(45) Date of Patent: Oct. 18, 2016

(54) ENHANCED OPTICAL ILLUSION FLUID DISPLAY DEVICE

(71) Applicant: L. Kenneth Rosenthal, Chino Hills, CA (US)

(72) Inventor: L. Kenneth Rosenthal, Chino Hills, CA (US)

( * ) Notice: Subject to any disclaimer, the term of this patent is extended or adjusted under 35 U.S.C. 154(b) by 139 days.

(21) Appl. No.: 14/175,049

(22) Filed: Feb. 7, 2014

(65) Prior Publication Data

US 2014/0226309 A1 Aug. 14, 2014

Related U.S. Application Data

(60) Provisional application No. 61/762,396, filed on Feb. 8, 2013.

(51) Int. Cl.

| | |
|---|---|
| ***F21V 33/00*** | (2006.01) |
| ***F21S 8/00*** | (2006.01) |
| ***G09F 19/00*** | (2006.01) |
| ***G09F 13/00*** | (2006.01) |
| ***G09F 13/24*** | (2006.01) |
| ***F21S 10/00*** | (2006.01) |
| *F21W 121/00* | (2006.01) |
| *G09F 13/22* | (2006.01) |
| *F21Y 101/00* | (2016.01) |

(52) U.S. Cl.

CPC ..... *G09F 13/24* (2013.01); *F21S 10/002* (2013.01); *F21W 2121/00* (2013.01); *F21Y 2101/00* (2013.01); *G09F 2013/222* (2013.01)

(58) Field of Classification Search

CPC ..... B67D 1/0056; B67D 1/0875; F21V 3/04; F21V 3/0472; F21V 3/0481; G09F 13/24

USPC ..... 362/96, 101; 40/406, 407, 408, 439, 40/442; 239/16–20

See application file for complete search history.

(56) References Cited

U.S. PATENT DOCUMENTS

| | | | | |
|---|---|---|---|---|
| 4,426,021 | A * | 1/1984 | Rosenthal | 222/129.1 |
| 5,165,580 | A * | 11/1992 | Rosenthal | 222/251 |
| 5,820,022 | A * | 10/1998 | Fukano et al. | 239/17 |
| 7,963,057 | B1 * | 6/2011 | Ruiz | 40/406 |
| 2004/0200471 | A1 * | 10/2004 | Rumens et al. | 126/512 |
| 2005/0135089 | A1 * | 6/2005 | Tau et al. | 362/145 |
| 2006/0150462 | A1 * | 7/2006 | Rossi | 40/700 |

OTHER PUBLICATIONS

Hackaday, http://hackaday.com/2011/03/11/water-droplet-sculpture-using-leds-and-arduino/, Published Mar. 11, 2011.*

* cited by examiner

*Primary Examiner* — Peggy Neils
*Assistant Examiner* — Alexander Garlen
(74) *Attorney, Agent, or Firm* — Perkins Coie LLP

(57) ABSTRACT

A fluid display device that produces the illusion of fluid droplets traveling up, traveling down or levitating, in a stable, smooth, and non-jerky motion. The fluid display device includes a housing, a reservoir for storing the fluid, an outlet nozzle for dispensing the fluid, a pump pulsating the fluid, an inlet for receiving the fluid from the outlet nozzle, and a light source having a color temperature of at least 5000 degrees K operating at or above flicker-fusion frequency to illuminate the fluid droplets.

26 Claims, 12 Drawing Sheets

ENHANCED OPTICAL ILLUSION FLUID DISPLAY DEVICE

This application claims the benefit of provisional patent application Ser. No. 61/762,396, filed on Feb. 8, 2013, which is hereby incorporated by reference.

FIELD OF THE INVENTION

The invention relates to an optical illusion fluid display device. In particular, an improved magical illusion fluid display device that produces an ideal, pleasing, nearly flawless and natural view of a very stable rising, falling, levitating and dancing droplets and/or solid stream of fluid with undulations and other magical illusion display patterns. Such fluid may be displayed vertically and non-vertically.

BACKGROUND OF THE INVENTION

Stroboscopic fluid displays are known in the prior art, and are interesting, magical, and puzzling to view. However, all such prior art display devices have various viewing and operational problems which fail to produce the ideal illusion. U.S. Pat. Nos. 4,426,021, 5,165,580, and D335,916 to Rosenthal disclose display devices that produce fluid droplets or solid stream with undulations rising, falling or levitating, and are incorporated herein by reference. These prior art display devices have many disadvantages:

These prior art display devices use Xenon bulb stroboscope directed at the fluid droplets or solid stream with undulations from above, which creates an uneven illumination on the fluid. Even with the use of additional diffusion optical elements along with the Xenon bulb, the effect is still not ideal due to the point source nature of the light source.

These prior art display devices also utilize expensive, large, noisy and heavy oscillating and/or vibrating pump system such as those disclosed in U.S. Pat. Nos. 3,136,257, 4,824,337, and 5,567,131.

These prior art display devices provide enclosures that only partly block bright ambient non-stroboscopic light, which lead to the viewing degradation of the illusion.

These prior art display devices operate with a fluid reservoir, a spigot, a basin and pipe systems which lead to increased splashing, fluid losses, unwanted vibrations, and inadequate monitoring of the fluid level which causes unit failure and poor fluid illusions.

These prior art display devices often require the presence of a system operator to ensure continued variation and novelty in the fluid illusion effects. Such devices are or were installed or displayed at the Hong Kong Museum of Science, Hotel Romeo in Naples, Italy, and Tokyo Disneyland Magic Shop, Quarks Bar at the Star Trek Adventure at the Las Vegas Hilton, and The Magic Castle Club in Hollywood.

Other prior art stroboscopic fluid display devices for vertical streams of droplets include one installed at the Exploratorium Museum in San Francisco, which was based on U.S. Pat. No. 3,387,782, Salvin's "Anti-Gravity Waterfall," which employs the vibrating pump of U.S. Pat. No. 4,265,402, water pearl devices covered by U.S. Pat. No. 5,820,022, and Harold Edgerton's florescent green dye based units previously displayed at the Massachusetts Institute of Technology in Cambridge, Mass., and local museums in the area, which was referenced in Harold Edgerton's book, *Electronic Flash, Strobe*. Such prior art devices, in addition to the problems previously identified, have other disadvantages. They produce small, unstable fluid droplets. The spectral stroboscopic lightings are poor and often use the incorrect white strobe light, uneven illumination or incorrect flicker fusion frequency. As a result, the droplet streams are difficult and unpleasant to view with on and off flashes on occasion. The devices produce an unnatural and not ideal illusion, and fail to capture the true beauty of the natural fluid, liquid, or water color. The display of several uncoordinated vertical streams of droplets moving all in only one direction at the same time also causes viewing confusion, improper backgrounds which hide or degrade the viewing of the illusion. These display devices are often large scale and not portable nor appropriate for display in a home environment.

Therefore, there is a need for an improved optical illusion fluid display device that produces fluid droplets and pattern of fluids that independently rise, fall, dance, change shape, levitate, appear and disappear, integrate with other illusion displays, jump, or move in three-dimensional maneuvers. Further, there is a need for an improved optical illusion fluid device that provides the fluid illusion in ambient light conditions that appear to be naturally-appearing with a pleasing white light and appropriate appearance. Still further, there is a need for a portable, quiet, light-weight, inexpensive, optical illusion fluid device that does not require an operator.

SUMMARY OF THE INVENTION

The invention relates to a device for displaying an optical illusion with fluid under certain ambient light conditions. The fluid as displayed is ideal and improved, pleasing, nearly flawless and a natural optical illusion. The fluid as displayed is very stable, can be rising or falling at different speeds, levitating, dancing large-size droplets, solid streams with undulations and other forms, both in changing and non-changing vertical, horizontal and hybrid formations, and other magical and puzzling appearing fluid patterns.

The display device of the present invention illuminates the fluid display above the flicker fusion frequency with constant illumination over the entire fluid display space with the use of light emitting diodes (LEDs) arrays which may be in a horizontal, vertical, curved, or hybrid position, or any combination of the above. The LEDs preferably operate in a higher color temperature to give the fluid a very natural looking appearance, and in the case of water, a cool, flawless, slightly blue-like color.

The display device of the present invention provides a unique housing which allows for constant and pleasing illumination of the fluid and significantly reduces unwanted illumination of ambient, non-stroboscopic light on the fluid display.

The display device of the present invention provides a housing that retains much of the fluid even with continued operation and display. The housing includes an easily attachable and removable rectangular clear curved or planar cover, top and bottom spigots, and bottom basin which prevents splashing and loss of liquid.

The display device of the present invention provides for a Demo mode which automatically provides pleasing fluid patterns of up or down at different speeds, levitating, and changing fluid patterns without operator intervention.

The display device of the present invention provides a quiet, reliable, light-weight and inexpensive oscillating or pumping system for a single or a plurality of horizontal or vertical droplets or pattern formations such that both up and down, and other optical fluid illusion patterns can be viewed simultaneously.

The display device of the present invention provides a flexible nozzle system which changes shape from oval to circular to other patterns for creating exciting and novel fluid droplets formations.

The display device of the present invention provides a three-dimensional, movable, flexible or rigid nozzle system which makes the rising and falling and levitating optical illusion droplets, solid streams, and other patterns appear to not only rise and fall in a vertical manner, but to magically move and dance both horizontally and vertically within the housing.

The display device of the present invention provides a level fluid monitoring system for ensuring that the reservoir has adequate fluid levels to prevent the oscillating or vibrating pump systems from malfunctioning and degrading the illusion. Such level fluid monitoring system also prevents the pump system from overheating. A temperature sensor or other sensor may be employed with appropriate display and feedback controls to accomplish such.

The display device of the present invention provides an inexpensive display which is easy to set up and operate, can operate for many hours or even days without operator intervention, is easy to clean and change fluid, and provides countless hours of pleasing and entertaining novel and dynamic fluid display.

DETAILED DESCRIPTION OF THE PREFERRED EMBODIMENTS

Figure 1:
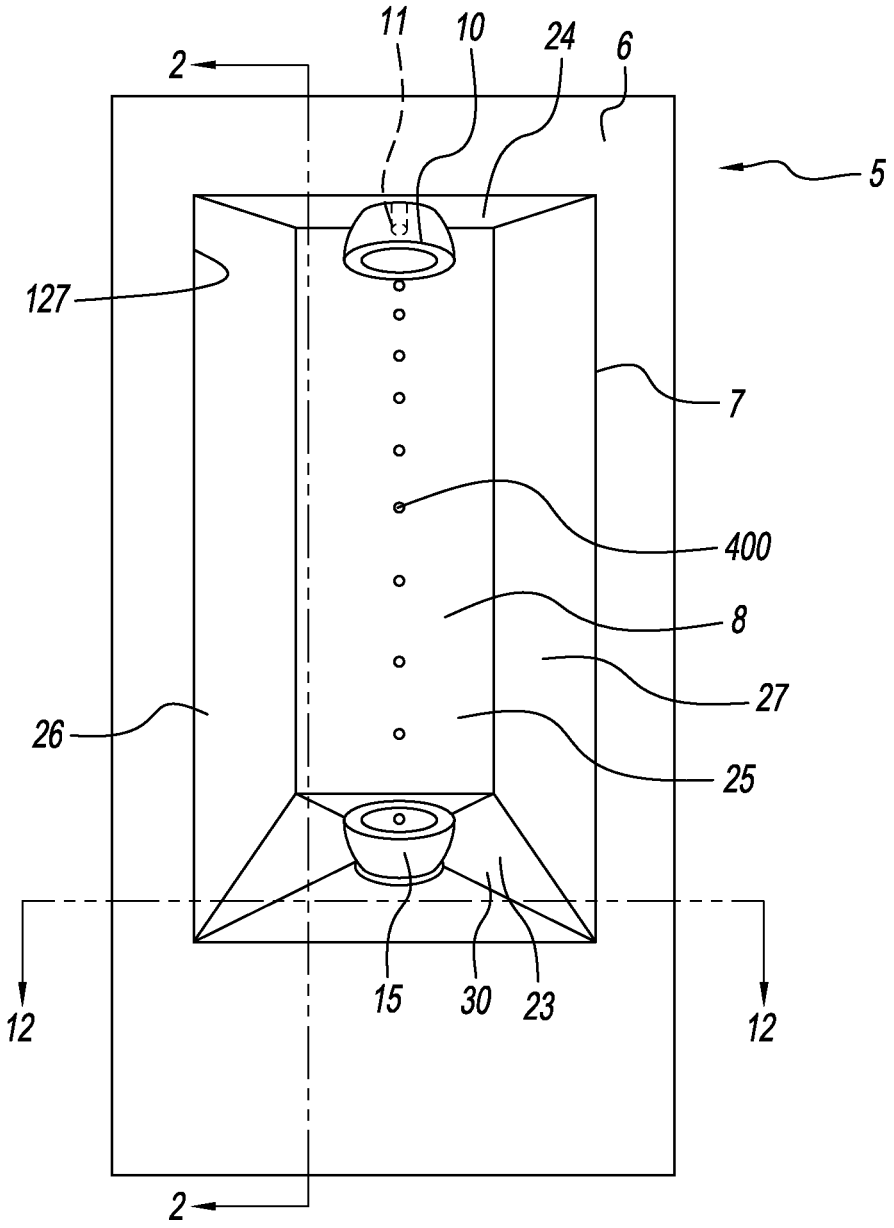
FIG. 1 shows a front view of the enhanced optical illusion fluid display device of the present invention.

With reference to the drawings, wherein the same reference number indicates the same element throughout, there is shown in FIG. 1 an enhanced optical illusion fluid display device 5 of the present invention showing one vertical stream of fluid droplets 400.

Figure 3:
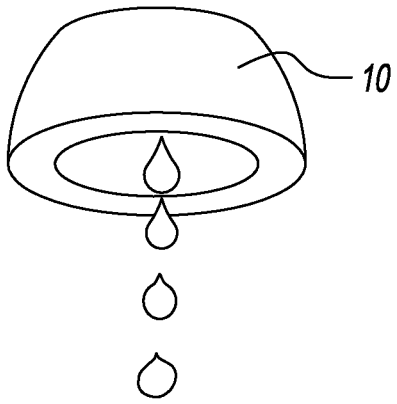
FIG. 3 is an enlarged front view of the top spigot illustrating a vertical droplet stream.
Figure 4:
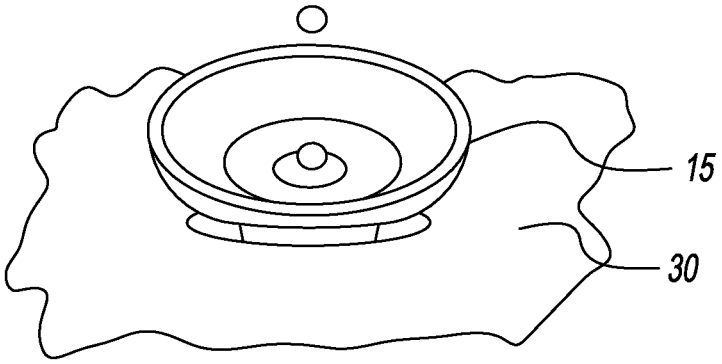
FIG. 4 is an enlarged perspective view of the bottom spigot, the basin and a vertical droplet stream.

The device 5 comprises a housing 6 having an opening 7 with an interior cavity 8. The interior cavity 8 is defined by left interior wall 26, right interior wall 27, back interior wall 25, upper interior wall 24 and lower interior wall 23. While the left interior wall 26, right interior wall 27 and back interior wall 25 are shown to be generally planar, they may also be non-planar or curved. FIGS. 1, 3, and 4 show a top spigot 10 and a bottom spigot 15. Top spigot 10 hides outlet nozzle 11 where the vertical stream of fluid droplets 400 exits and the bottom spigot 15 receives the fluid droplets 400 and minimizes splashing. The lower interior wall 23 defines a basin 30 for capturing splashed fluids and delivering splashed fluids back to the reservoir 12 for re-circulation through the pump system.

Figure 2:
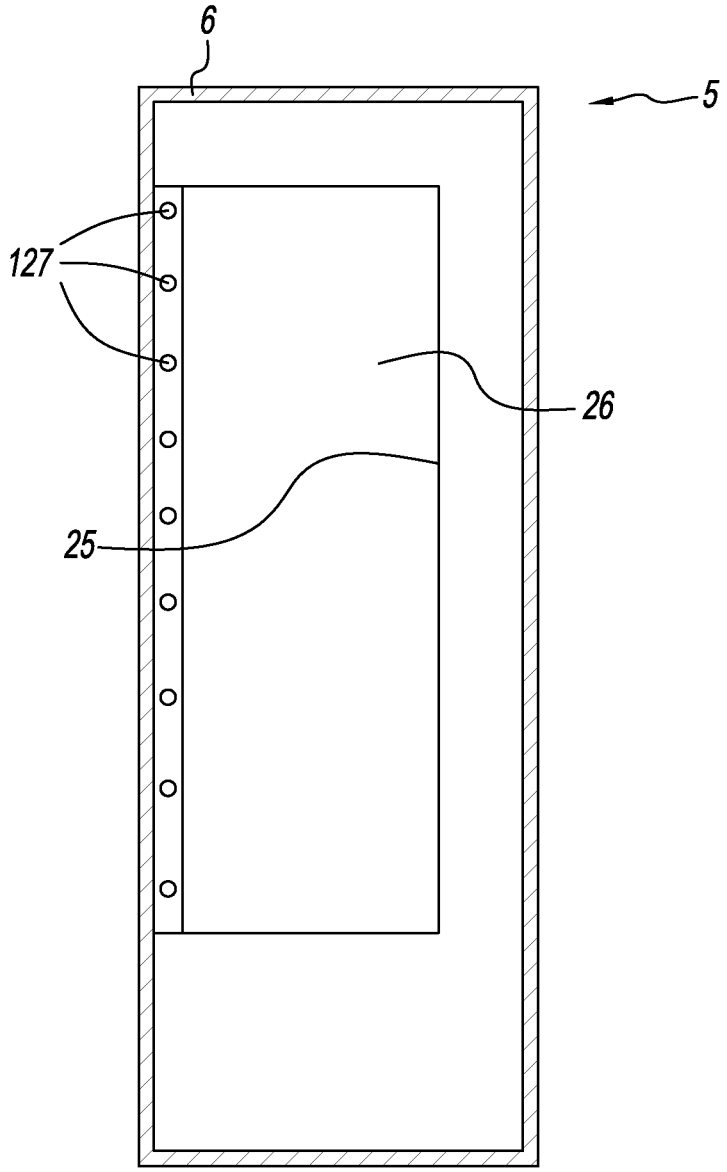
FIG. 2 is a cross-sectional view taken along Line 2-2 in FIG. 1 showing a vertical LED array.

As shown in FIGS. 1 and 2, an array of stroboscopic LEDs 127 that are vertically aligned is hidden from front view in FIG. 1 just inside the housing 6 at the edge of opening 7 in the interior cavity 8. In one embodiment the individual LEDs 127 are evenly spaced corresponding to the number of fluid droplets 400. For example, in a ten inch vertical stream of ten fluid droplets 400 there would be ten individual LEDs 127. The stroboscopic light from the LED vertical array 127 first passes through the vertical stream of fluid droplets 400 and then scatters and also reflects off of left interior wall 26, right interior wall 27, and back interior wall 25. All three interior walls 26, 27, and 25 preferably have a matte finish such as white linoleum (either flat or curved in shape) or a light color. In most environments, the three interior walls 26, 27, and 25 are not glossy, dark, or use a mirror-like material. The matte interior walls 26, 27, and 25 function like an integrating sphere illumination to provide a uniform and natural background. The matte interior walls 26, 27, and 25 also enhance the showing of a shadow of the fluid droplets 400 for a more pleasant and natural viewing.

The spectral output of each LED 127 has a color temperature above 5000 degrees K to provide a more natural appearance for the fluid droplets 400. Each LED 127 has a color rendering index (CRI) of about 85-90. The use of LEDs having color temperatures below 5000 degrees K, or even below 3000 degrees K, will result in the fluid droplets 400 having an unnatural yellow or similar color and will be degraded and difficult to view, especially if the interior walls 26, 27, and 25 do not have a matte finish for back lighting and integrating sphere illumination such that ambient light affects the viewing of the droplets 400. LEDs 127 having a color temperature of less than 5000 degrees K may be used in combination with LEDs 127 having a color temperature of above 5000 degrees K to achieve a surprisingly satisfactory result. For example, a combination of LEDs 127 having a color temperature of above 3500, but less than 5000, degrees K may be used along with LEDs 127 having a color temperature of more than 5000 degrees K.

Figure 8:
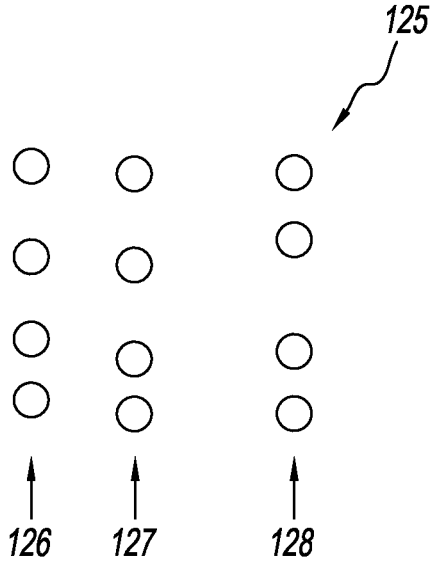
FIG. 8 shows three sample LED arrays which may be angled at different degrees in the horizontal and vertical and/or hybrid configurations.

While the device 5 shown in FIGS. 1 and 2 has one vertical stream of fluid droplets 400, it may also have multiple vertical streams of fluid droplets 400 exiting one or more outlet nozzles 11. The vertical stream of fluid droplets 400 may be several feet tall, with the spacing between the fluid droplets 400 increasing as the droplets 400 fall. For optimum viewing of the multiple vertical streams of fluid droplets 400, the array of LEDs 127 may optionally have individual LEDs 127 that are not spaced apart equally, but correspond to the increased spacing of fluid droplets 400. Alternatively, depending on the patterns of the droplets 400, whether it is a solid stream with undulation or other formations under the stroboscopic LEDs 127, the individual LEDs 127 may be positioned to provide maximum uniformity of illumination in a non-uniformly spaced distance from each other. FIG. 8 illustrates three differently spaced array of LEDs 126, 127 and 125. As another alternative, an evenly spaced array of LEDs 127 may be controlled by a processor 120 to selectively turn on the corresponding LEDs 127 at selective flash rate to illuminate the droplets 400 formation that is also controlled by the processor 120 (by controlling the rate/intensity of the pump 50).

Figure 12:
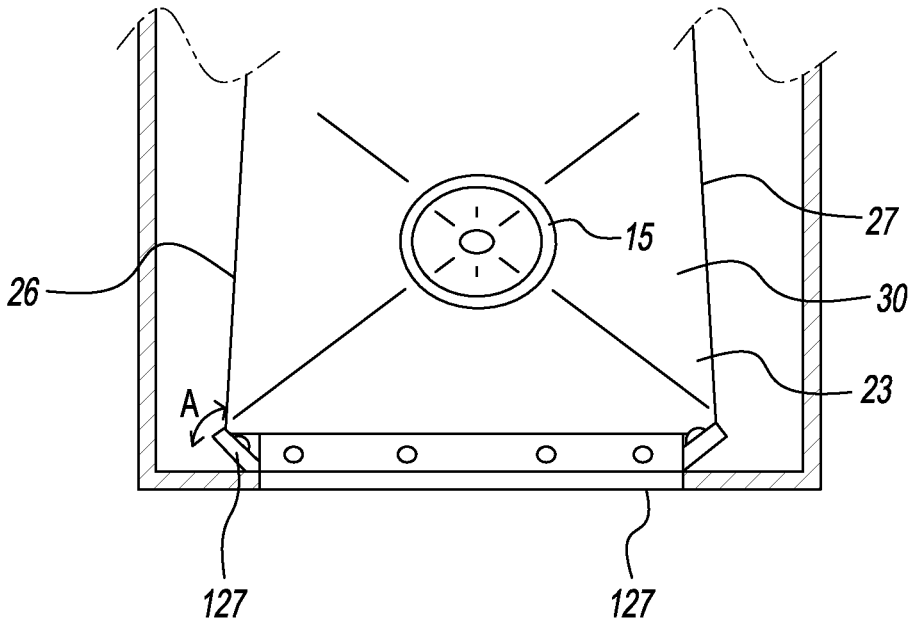
FIG. 12 is a cross-sectional view taken along line 12-12 in FIG. 1 showing a horizontal LED array.
Figure 13:
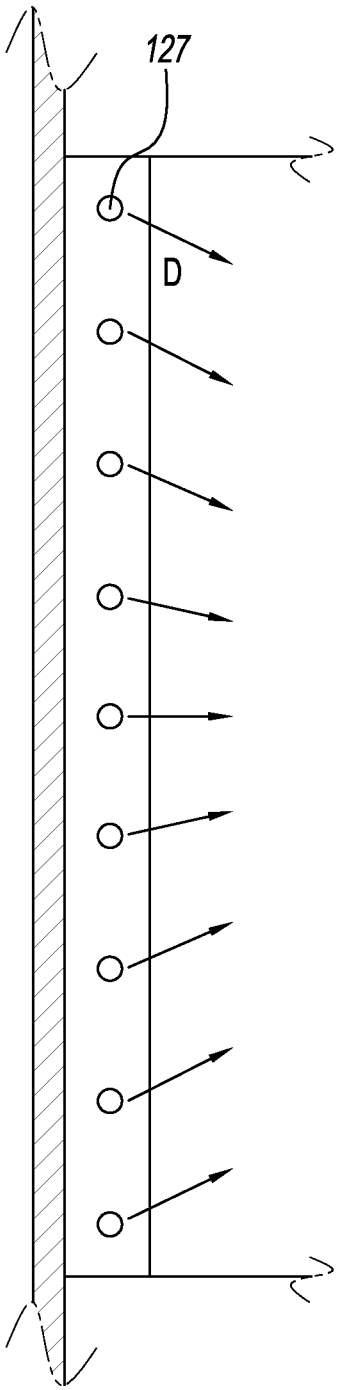
FIG. 13 is an enlarged view of the LED array as shown in FIG. 2.
Figure 14:
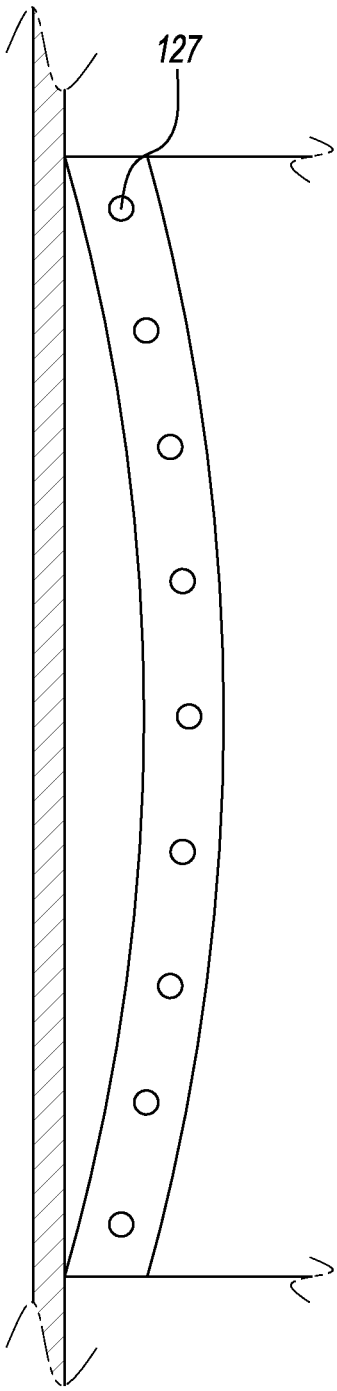
FIG. 14 is an alternate LED array of FIG. 12 shown in a curved configuration.

The array of LEDs 127 may be positioned vertically and/or horizontally or at an angle or curved configuration within the housing hidden from front view to provide an ideal and naturally uniform illumination to show the shadow of the droplets 400 on the interior walls 26, 27, and 25. FIG. 12 shows a horizontal array of LEDs 127 adjacent the lower interior wall 23 hidden from front view just inside the housing 6 at the edge of opening 7 in the interior cavity 8. The horizontal array in FIG. 12 shows four (4) LEDs 127. Similar to the vertical array, any number of LEDs 127 may be used in the horizontal array. A corresponding horizontal array of LEDs 127 may be similarly positioned adjacent the upper interior wall 24 hidden from front view just inside the housing 6 at the edge of opening 7 in the interior cavity 8. As shown in FIG. 13, each LED 127 may be directed at a different angle as shown by directional arrow D to achieve ideal illumination of the fluid droplets 400. Alternatively, the LEDs 127 may all be directed at the same angle. The angle of the direction can be in any of the 360 degree direction available. The entire array of LEDs 127 may also be tilted or angled at any directional angle A, as shown in FIG. 12, directing at the fluid droplets 400. FIG. 14 shows a curved configuration of the vertical array of LEDs 127. Other curved or random configurations may be used for the vertical or horizontal array of LEDs 127.

Figure 7:
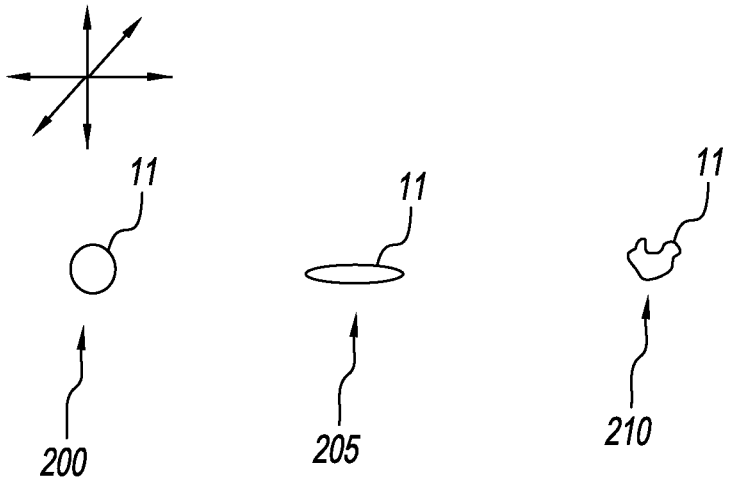
FIG. 7 shows three output nozzle configurations along with a three-dimensional graph which shows the directions the output nozzles can be moved.

Outlet nozzle 11 may be configured to be a circular nozzle 200 or an oval nozzle 205 as shown in FIG. 7. Fluid droplets 400 exiting either nozzle 200 or 205 are shaped in an oval configuration. A typical size for fluid droplets 400 are ¼ inch by ½ inch to ¾ inch from a nozzle having a cross-sectional orifice size of ½ inch in diameter. Other larger sizes and shapes may be realized by changing the nozzle orifice size. Outlet nozzle 11 may be directed at any angle and may be moved in a three-dimensional manner in any direction as shown in FIG. 7 such that the vertical stream of fluid droplets 400 may become non-vertical, spiral, partly horizontal, and other three-dimensional magical-like patterns. Such three-dimensional movement can be accomplished by any method known to one skilled in the art, such as manual movement, mechanical movement via a motor, etc.

Outlet nozzle 11 may also be shaped as an irregular shaped nozzle 210, with the resulting fluid droplets 400 or fluid streams with undulations being non-oval and non-spherical fluid droplets 400. Three-dimensional movement of irregular shaped nozzle 210 may result in a non-vertical, spiral-like, or dancing-like patterns of magically rising, levitating, or slowly falling fluid. Outlet nozzle 11 may be fixedly shaped as a spherical nozzle 200, an oval nozzle 205, or an irregular shaped nozzle 210. Alternatively, an outlet nozzle 11 may be mechanically manipulated in a two-dimensional manner such that the cross-sectional orifice temporarily forms a circular nozzle 200, an oval nozzle 205 or different irregular shaped nozzles 210, by, for example, pinching, squeezing, or clamping the outlet nozzle 11 via any mechanical means known to one skilled in the art.

Figure 6:
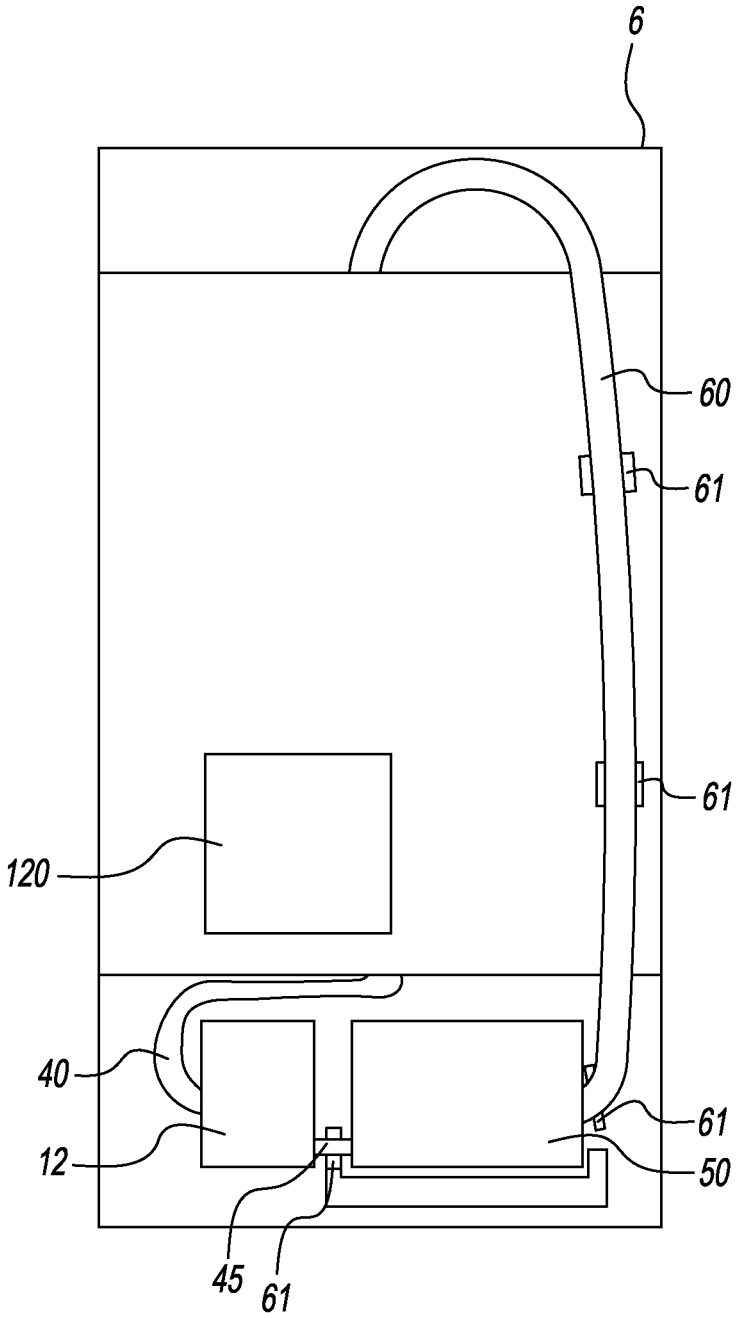
FIG. 6 is a simplified rear view showing only the major components inside the housing.

FIG. 6 shows a pulsating and/or oscillating pump 50 that is compact and quiet, which provides approximately 50 to 60 Hertz droplet formation to output tube 60, which is connected to the outlet nozzle 11. Fluid droplets 400 re-enters the pump system when it is collected by the bottom spigot 15 or the basin 30. Via a receiving tube 40, fluid flows from the bottom spigot 15 to a reservoir 12. The reservoir 12 stores the fluid and provides it to the pump 50 via input tube 45. Both output tube 60 and input tube 45 are anchored by braces 61 to prevent transverse vibration which would degrade the illusion (since only longitudinal vibration is needed or desired). Further, lengths of both the output tube 60 and input tube 45 are adjusted such that they do not induce transverse vibration resonance along with braces 61 as to degrade illusion (since, again, only longitudinal resonance and oscillation which enhance the illusion and keeps fluid droplet 400 and other illusion fluid forms very stable and consistent are allowed and desired). For a device 5 that has more than one vertical streams of fluid droplets 400, each stream may be driven by the same pump 50 or by different pumps 50 each having a different frequency. Each stream may have the same or different outlet nozzles 11. Even without three-dimensional movements of each outlet nozzle 11 of the multiple vertical streams of fluid droplets 400, if each stream is driven by a different pump 50 with different frequency, an array of LEDs 125 strobing at a fixed rate can produce some up, down and levitation illusion on the multiple vertical streams of fluid droplets 400 at the same time.

Figure 5:
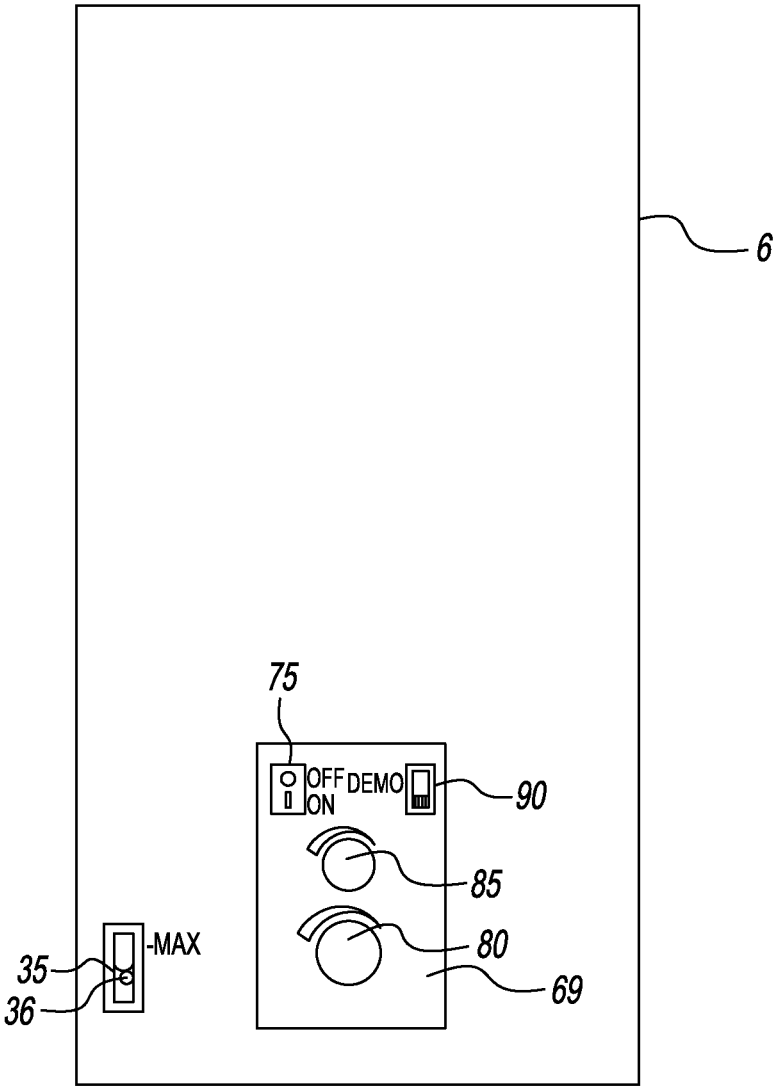
FIG. 5 is a rear view showing the control panel.

FIG. 5 shows control panel 69 which contains a pump knob 80 for manual rheostat, solid state, or variable transformer adjustment for the rate/intensity of the pump 50, a LED strobe knob 85 for manual adjustment of flash rate from 50 to 70 Hertz above the flicker fusion frequency, an on/off switch 75, and a Demo switch 90. The ability to independently adjust the rate/intensity of the pump 50 and the flicker fusion frequency of the LED 127 advantageously provides a user with easy control to produce the ideal visual effect, especially in a dim or dark environment. A fluid level indicator 35 is also provided to show the level of fluid in the reservoir 12, and signals low fluid levels to prevent illusion degradation and the pump 50 from overheating, which can damage the pump 50. Device 5 may also incorporate an automatic shut-off system if the processor 120 or a sensor detects a dangerously low level of fluid. Fluid level indicator 35 includes a floating ball 36 to clearly show the fluid level. Since device 5 is more dramatically displayed in an environment with minimum ambient light, the floating ball 36 may be coated with a glow in the dark material to improve viewing or the indicator 35 may be internally lit with a light source such as a LED. When the indicator 35 shows a lower level of fluid, due to splashing or evaporation of the fluid, reservoir 12 may be re-filled by pouring fluid into the bottom spigot 15. Alternatively, access to the reservoir 12 may be provided from the rear of the housing. In alternate embodiments, the fluid level indicator 35 may produce a sound or a flashing light when the fluid level is low.

FIG. 6 shows a processor 120 that may control the array of LEDs 127 and pump 50 instead of the manual knobs 80 and 50. A power supply (not shown) provides power to the processor 120, pump 50 and the LEDs 127, which may be within the housing 6 (such as batteries) or external to the housing 6 (such as an AC adaptor). Pump 50 may pulsate or oscillate at a fixed rate or a non-fixed rate between 50 to 70 Hertz. Similarly, LEDs 127 may have a fixed flash rate or a non-fixed flash rate between 50 to 70 Hertz. Signal from the processor 120 may vary the rate/intensity of the pump 50 and flash rate of the LEDs 127. Varying the rate/intensity of the pump 50 while the flash rate of stroboscopic LEDs 127 is held steady, the stream of droplets 400 would rise, fall and levitate. Similarly, varying the flash rate of the LEDs 127 while the rate of the pump 50 is held steady, the stream of droplets 400 would rise, fall and levitate. Further, increasing the flash rate of the LEDs 127 will increase the number of viewable droplets 400 (e.g. double the flash rate to 100 to 140 Hertz will result in double the number of droplets 400).

The device 5 of the present invention can produce very interesting visual effects of the stream of fluid droplets 400 with LEDs 127 flashing at different flash rates. For example, a first set of LEDs 127 may have a flash rate of 65 Hertz and a second set of LEDs 127 may have a flash rate of 55 Hertz, and with the pump 50 at a pulsating rate of 60 Hertz, the stream of fluid droplets 400 would have both droplets going up and droplets going down. If the second set of LEDs 127 has a flash rate of 70 Hertz instead of 55 Hertz, then two sets of droplets 400 would travel in the same direction at two different speeds. In another example, two separate streams of fluid droplets 400 may be independently illuminated by the first and second sets of LEDs 127 such that one stream of fluid droplets 400 have droplets going up and the other stream of fluid droplets 400 have droplets going down. In order to achieve this effect within a device 5, it is important to isolate the illumination of the first and second sets of LEDs 127 to its respective streams of fluid droplets 400 to prevent interference of the illumination, which would degrade the visual effect. To further enhance this effect, each stream of fluid droplets 400 may be illuminated with different color LEDs 127.

When the Demo switch 90 is in the on position, a set of pre-programmed non-repeating fluid patterns are displayed that move slowly up, quickly up, levitation, slowly down, and quickly down to ensure long periods of interesting illusion movement to capture an audience's interest. One example of the Demo mode can be described as follow (5UPS mean 5 seconds of up slow movement, 10UPF mean 10 seconds of up fast movement, 3DS mean 3 seconds of down slow movement, 7DF mean 7 seconds of down fast movement, 8L mean 8 seconds of levitation, and the leading number may be changed to reflect a change in seconds): 5UPS, 10UPF, 3DS, 7DS, 8L . . . 4US, 3UPF, 5L, 6UF, 4DF, 3L, 7UF, 2DF, etc. In comparison, patterns with simple repetition: 4UF, 4DF, 4L, etc. are generally not very visually interesting. Displaying patterns with many variations provide a dynamic entertaining experience to a viewer. Due to the configuration of the present invention, the Demo mode is able to display non-jerky, smooth, gentle flowing droplets 400 despite the transitions of the droplet display effect during the Demo mode.

Figure 9:
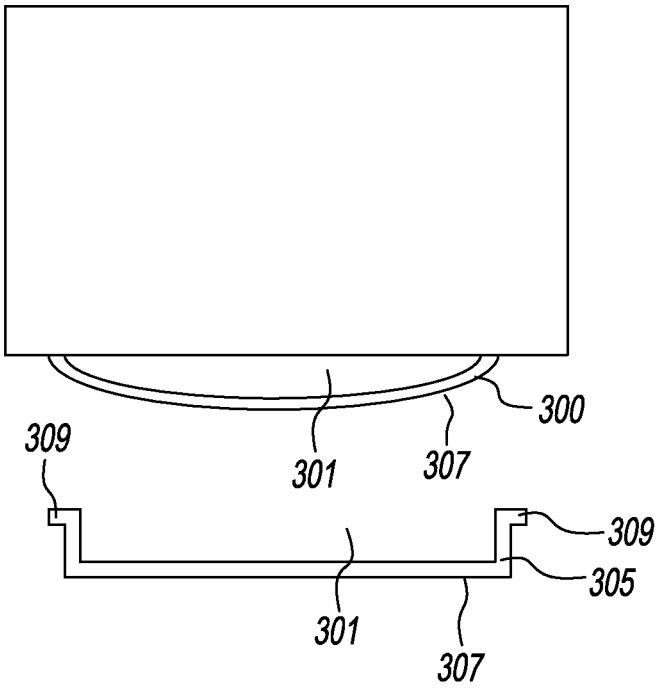
FIG. 9 is a top view showing a clear curved cover and an alternative planar cover which may be easily attached or detached from the housing.

FIG. 9 shows a removably attached transparent generally rectangular curved cover 300 or planar cover 305 that can be placed in the opening 7 of the display 5 to prevent access to the interior cavity 8 by a viewer. Cover 300 or 305 can also keep the fluid from exiting the interior cavity 8 and captures any splashing of fluid droplets 400. Cover 300 or 305 can be coated with an invisible coating 307 that blocks some of the ambient light but allows a high percentage of the stroboscopic light through to the viewers. In one embodiment, cover 300 or 305 has an invisible coating 307 allows a high percentage of the high color temperature, blue wavelength light (most of which is in the strobe light from LEDs 127) to pass, and blocks the low color temperature, warm wavelength light (most of which is in the ambient, non-stroboscopic, light environment). The covers 300 and 305 are shown to have openings at the top 301 to minimize or prevent any condensation from being collected on the inside surface of the covers 300 and 305. Such openings can be smaller than as shown and may be positioned in any location of the covers 300 and 305 other than the top 301.

Figure 10:
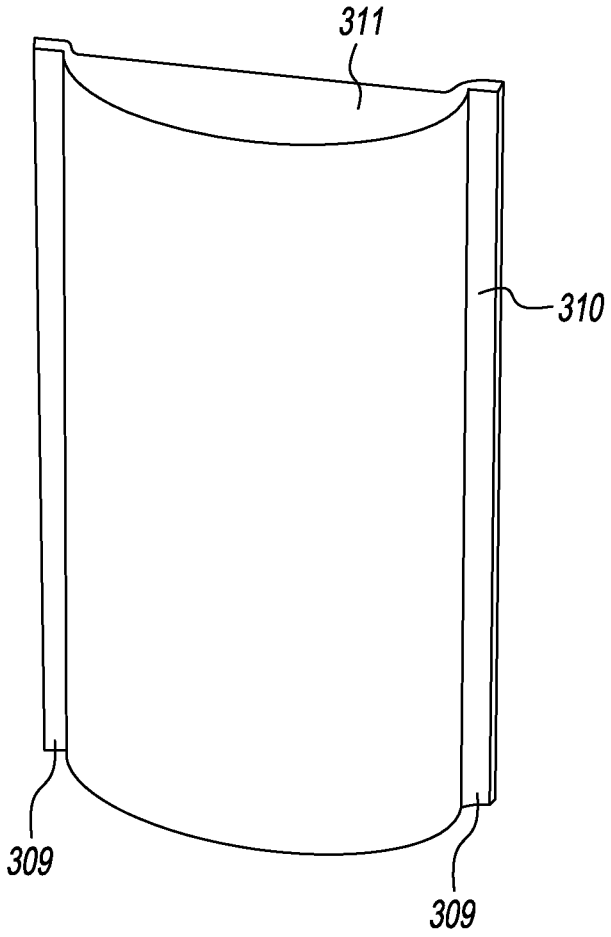
FIG. 10 is perspective view of the clear curved cover.
Figure 11:
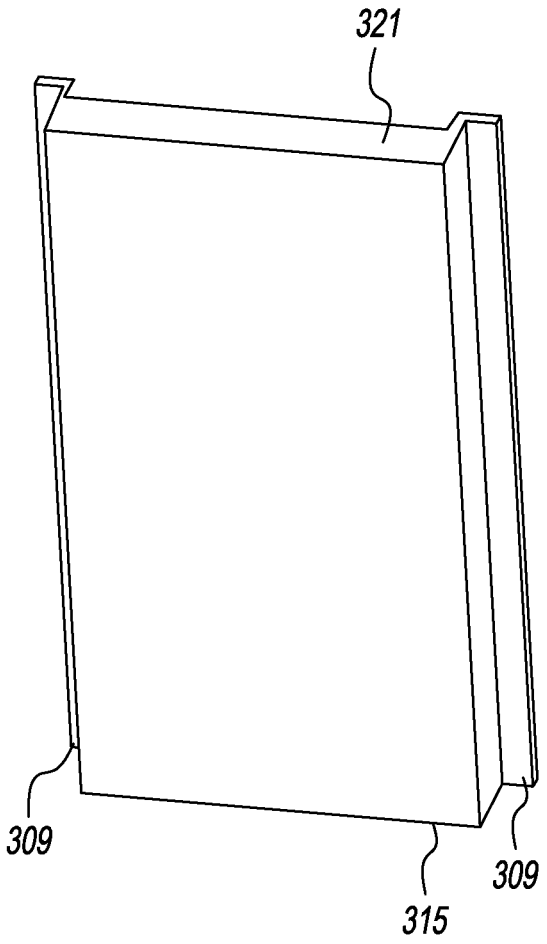
FIG. 11 is a perspective view of the clear planar cover.

FIG. 10 shows another transparent cover 310 similar to cover 300 of FIG. 9, except that the top 311 has a smaller opening. The flange 309 on either side of the cover 310 (and cover 305) engages the opening 7 inside the interior cavity 8. FIG. 11 shows another transparent cover 315 similar to cover 305 of FIG. 9, except that the top 321 has a small opening. The flange 309 on either side of the cover 315 engages the opening 7 inside the interior cavity 8. If a transparent cover 300, 305, 310 or 315 is not used, a user may touch the vertical stream of droplets 400 at a recommended angle of 45 to 90 degrees to avoid splashing.

For display 5 that has only several vertical droplet streams 400 that are less than 12 inches in length, then the display 5 will be portable. For display 5 that has multiple vertical, horizontal, or 3-dimensionally moving fluid droplets 400 of several feet or meters in length, then the display 5 will likely be non-portable.

The display 5 of the present invention provides many advantages over the prior art devices. For example, use of high color temperatures stroboscopic LEDs 127 at or above the flicker fusion frequency; use of interior light color matte material in the flat or curved interior walls 26, 27 and 25 for integrating sphere illumination; vertical or horizontal arrays or a hybrid combination of LEDs 127 to achieve natural, uniform, and non-degraded illumination; use of differently shaped outlet nozzles 11; three-dimensional movement of the outlet nozzles 11; length adjustment and clamping of the input tube 45 and output tube 60 going into and out of the oscillating pump 50 to avoid undesirable transverse vibrations; use of a compact, inexpensive, and quiet pump 50; Demo mode to provide a dynamic, non-repetitive, smooth, non jerky display of fluid droplets 400; and transparent covers 300 or 305 with coatings 307 for enhancing the stroboscopic viewing and minimizing the ambient light.

The present invention has been described as a circulating fluid display device 5 such that the fluid droplets 400 are intended to remain within the device. However, the present invention can also be used as a non-circulating fluid display device, i.e. for dispensing of fluid. When the vertical stream of fluid droplets 400 exit the top spigot 10, a user can collect the fluid by placing a container in the vertical stream of fluid droplets 400. In order to use the present invention as a non-circulating fluid display device, the reservoir 12 will have been continuously replenished. Continuous replenishment may be accomplished with a continuous in flow of fluid into the reservoir 12 via an external source. To produce the ideal illusion and to be able to move a container up and down the fluid display device 5, a clear container having a height of less than ⅓ of the length of the stream of fluid droplets should be used.

The features of the invention illustrated and described herein are the preferred embodiments. Therefore, it is understood that the specification is intended to cover unforeseeable embodiments with insubstantial differences that are within the spirit of the specification.

What I claim is:

1. A fluid display device comprising:

a housing having an opening, said opening having an edge;

an interior cavity having a matte finish within said housing defined by said opening, having at least a left interior wall, a right interior wall, a back interior wall, an upper interior wall and a lower interior wall;

a reservoir within said housing for storing the fluid;

at least one outlet nozzle within said interior cavity for dispensing a stream of the fluid, wherein said at least one outlet nozzle is movable;

a pump within said housing for delivering pulsating fluid at a predetermined intensity from said reservoir to said at least one outlet nozzle;

at least one inlet within said interior cavity spaced apart from said at least one outlet nozzle for receiving the fluid being dispensed from said at least one outlet nozzle for re-circulating back to said reservoir; and at least three light sources having a color temperature of at least 5000 degrees K operating at a flash rate at or above flicker-fusion frequency directed at the stream of fluid between said outlet nozzle and said inlet and located in the interior cavity at said edge of said opening such that said light source is not viewable from outside said housing, and wherein said at least three light sources are increasingly spaced from one another, such spacing corresponding to an increased spacing of the pulsating fluid falling within said interior cavity.

2. The device of claim 1 further comprises at least one light source having a color temperature of at least 3500 degrees K operating at or above flicker-fusion frequency directed at the stream of fluid between said outlet nozzle and said inlet.

3. The device of claim 1 further comprises at least one input tube connecting between said outlet nozzle and said pump, and at least one output tube connecting between said inlet and said reservoir, wherein said input and output tubes are mounted within said housing to minimize transverse vibration and said input and output tubes each having a length that minimizes induction of transverse vibration resonance.

4. The device of claim 1 wherein said input and output tubes are made of silicon.

5. The device of claim 1 wherein each of said at least one outlet nozzle has a different cross-sectional shape.

6. The device of claim 1 wherein said outlet nozzle is located at said upper interior wall, and said inlet is located at said lower interior wall.

7. The device of claim 1 further comprises means for changing the cross-sectional shape of each of said at least one outlet nozzle to produce different stream of fluid.

8. The device of claim 1 further comprises means for moving each of said at least one outlet nozzle in any direction horizontally, vertically, diagonally, linearly, non-linearly, 2-dimensionally, and 3-dimensionally.

9. The device of claim 1 wherein said at least one outlet nozzle is directable at any angle.

10. The device of claim 1 wherein said at least three light sources are directable at the stream of fluid at any angle.

11. The device of claim 1 wherein said interior cavity is light in color.

12. The device of claim 1 wherein said interior cavity having at least one planar wall.

13. The device of claim 1 wherein said interior cavity having at least one curved walls.

14. The device of claim 1 further comprises a transparent cover that removably engages said opening to prevent access to said interior cavity.

15. The device of claim 14 wherein said transparent cover is generally planar.

16. The device of claim 14 wherein said transparent cover is generally curved.

17. The device of claim 14 wherein said transparent cover having a coating that keeps ambient light out of said interior cavity.

18. The device of claim 1 wherein said at least three light sources comprise a plurality of LEDs positioned adjacent said opening in said interior cavity.

19. The device of claim 18 wherein said plurality of LEDs are positioned vertically adjacent said opening in said interior cavity.

20. The device of claim 18 wherein said plurality of LEDs are positioned horizontally adjacent said opening in said interior cavity.

21. The device of claim 1 further comprises a processor for controlling the flash rate of each light source.

22. The device of claim 1 further comprises a control for controlling the intensity of said pump.

23. The device of claim 1 further comprises a fluid level indicator on said housing showing the level of fluid in said reservoir.

24. The device of claim 1 wherein said at least three light sources having a color rendering index of about 85-90.

25. A fluid display device comprising:

a housing having an opening, said opening having an edge;

an interior cavity having a matte finish within said housing defined by said opening, having at least a left interior wall, a right interior wall, a back interior wall, an upper interior wall and a lower interior wall;

a means for storing the fluid;

a means within said interior cavity for dispensing a stream of the fluid;

a means for changing fluid droplets into oval, spherical, or amorphous shapes;

a means for moving fluid droplets in a lateral direction;

a means for delivering pulsating fluid at a predetermined intensity;

at least one inlet within said interior cavity for receiving the fluid being dispensed;

at least three light sources having a color temperature of at least 5000 degrees K operating at a flash rate at or above flicker-fusion frequency directed at the stream of fluid between said outlet nozzle and said inlet and located in the interior cavity at said edge of said opening such that said light source is not viewable from outside said housing; and wherein said at least three light sources are increasingly spaced from one another, such spacing corresponding to an increased spacing of the pulsating fluid falling within said interior cavity.

26. The fluid display device of claim 1, wherein said fluid is water.

* * * * *